US011073321B2

(12) United States Patent
Park et al.

(10) Patent No.: US 11,073,321 B2
(45) Date of Patent: Jul. 27, 2021

(54) REFRIGERATOR AND METHOD OF MANUFACTURING AUGER FOR THE REFRIGERATOR

(71) Applicant: Samsung Electronics Co., Ltd, Gyeonggi-do (KR)

(72) Inventors: Kyoung Ki Park, Yongin-si (KR); Min Seob Yook, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/835,918

(22) Filed: Dec. 8, 2017

(65) Prior Publication Data

US 2018/0164018 A1 Jun. 14, 2018

(30) Foreign Application Priority Data

Dec. 13, 2016 (KR) ..... 10-2016-0169657

(51) Int. Cl.
*F25C 5/20* (2018.01)
*F25C 5/182* (2018.01)
*F25D 11/02* (2006.01)

(52) U.S. Cl.
CPC ..... *F25C 5/22* (2018.01); *F25C 5/182* (2013.01); *F25D 11/02* (2013.01); *F25C 2500/02* (2013.01)

(58) Field of Classification Search
CPC ..... F25C 5/22; F25C 5/182; F25C 2500/02; F25D 11/02; B65G 33/30; B27G 15/00; A23G 9/045; A23G 9/224
USPC ..... 76/2, 3; 366/144, 145, 147, 148, 279; 62/460, 461
See application file for complete search history.

(56) References Cited

U.S. PATENT DOCUMENTS 1,573,658 A * 2/1926 Thompson ..... A23G 9/224 366/194
2,014,636 A * 9/1935 Rosendahl ..... B65G 33/30 366/343

(Continued)

FOREIGN PATENT DOCUMENTS

CN 1573267 A 2/2005
CN 101038117 A 9/2007

(Continued)

OTHER PUBLICATIONS

International Search Report for PCT Patent Application No. PCT/KR2017/014306 dated Apr. 27, 2018; 3 pages.

(Continued)

*Primary Examiner* — Len Tran
*Assistant Examiner* — Kristin U Oswald

(57) ABSTRACT

Disclosed is a refrigerator. The refrigerator includes a body which includes a storage compartment, an ice maker provided in the storage compartment and configured to form ice, an ice bucket in which the ice formed by the ice maker is stored, and an auger provided in the ice bucket and configured to include a rotating shaft and an extension portion radially extended from the rotating shaft while being spirally extended along the rotating shaft. Here, the extension portion includes a plurality of transfer portions configured to include perimeter edges spirally extended and side edges radially extended and to be arranged to allow the perimeter edges to form a continuous spiral shape.

16 Claims, 11 Drawing Sheets

(56) References Cited

U.S. PATENT DOCUMENTS 2,221,680 A * 11/1940 Parrish ..... E21B 10/44 175/394
2,576,995 A * 12/1951 Carvel ..... A23G 9/224 366/310
3,005,551 A * 10/1961 Kesinger ..... A01F 11/06 209/136
3,214,935 A * 11/1965 Conto ..... F25C 1/147 62/298
3,326,014 A * 6/1967 Fiedler ..... F25C 1/147 62/320
3,501,927 A * 3/1970 Wadsack ..... F25C 1/147 62/320
3,511,059 A * 5/1970 Hoenisch ..... F25C 5/187 62/138
3,779,033 A * 12/1973 Swanson ..... F25C 1/147 62/354
3,929,196 A * 12/1975 Rantanen ..... F25C 5/04 175/18
4,129,015 A * 12/1978 Morris, Jr. ..... F25C 5/24 62/344
4,176,527 A * 12/1979 Linstromberg ..... F25C 5/046 222/240
4,343,394 A * 8/1982 Emmert ..... B65G 33/30 198/550.6
4,574,593 A * 3/1986 Nelson ..... F25C 1/147 62/320
4,627,556 A * 12/1986 Brooks ..... F25C 5/22 222/240
4,694,661 A * 9/1987 Landers ..... F25C 5/24 62/344
4,942,979 A * 7/1990 Linstromberg ..... F25C 5/22 221/75
4,972,999 A * 11/1990 Grace ..... F25C 5/046 241/101.1
5,037,004 A * 8/1991 Katz ..... F25C 5/22 222/146.6
5,165,255 A * 11/1992 Alvarez ..... F25C 5/182 222/129.1
5,443,588 A * 8/1995 Loppoli ..... B65G 33/30 414/526
6,502,649 B1 * 1/2003 Havel ..... E21B 7/008 175/18
6,904,765 B2 6/2005 Lee et al.
7,762,097 B2 * 7/2010 Jeong ..... F25C 5/22 62/340
7,946,355 B1 * 5/2011 Kluge ..... E21B 7/008 175/18
9,506,680 B2 11/2016 Jeong et al.
10,948,227 B2 * 3/2021 Jeong ..... F25C 5/22
2007/0084230 A1 4/2007 Krause et al.
2007/0214825 A1 * 9/2007 Jeong ..... F25C 5/22 62/344
2008/0156023 A1 * 7/2008 Kim ..... F25C 5/22 62/344
2011/0126576 A1 6/2011 Jeong
2013/0174596 A1 * 7/2013 Kim ..... F25C 5/182 62/320
2015/0135757 A1 * 5/2015 Mitchell ..... F25C 1/00 62/340
2016/0116199 A1 4/2016 Fischer et al.
2016/0298895 A1 10/2016 Drach et al.

FOREIGN PATENT DOCUMENTS

CN 102767932 A 11/2012
JP 2004-12061 A 1/2004
KR 1020060135325 A 12/2006
KR 1020070034396 A 3/2007
KR 10-2007-0093610 A 9/2007
KR 1020070093610 A 9/2007
KR 1020110079967 A 7/2011
KR 10-2013-0078530 A 7/2013
KR 10-2013-0078532 A 7/2013
KR 10-2013-0081136 A 7/2013

OTHER PUBLICATIONS

European Patent Office, "Supplementary European Search Report," Application No. EP17881159, Jul. 3, 2019, 7 pages.
Office Action dated Jun. 25, 2020 in connection with India Patent Application No. 201817032629, 6 pages.
Notice Requesting Submission of Opinion dated Oct. 19, 2020 in connection with Korean Patent Application No. 10-2016-0169657, 22 pages.
Office Action dated Dec. 31, 2020 in connection with Chinese Patent Application No. 201780057919.6, 14 pages.
Communication under Rule 71(3) EPC dated Jan. 21, 2021 in connection with European Patent Application No. 17 881 159.2, 31 pages.
Korean Intellectual Property Office, "Notice of Decision for Rejection" dated Mar. 23, 2021, in connection with Korean Patent Application No. 10-2016-0169657, 8 pages.
Korean Intellectual Property Office, "Notice of Patent Allowance" dated Apr. 30, 2021, in connection with Korean Patent Application No. 10-2016-0169657, 3 pages.

* cited by examiner

REFRIGERATOR AND METHOD OF MANUFACTURING AUGER FOR THE REFRIGERATOR

CROSS-REFERENCE TO RELATED APPLICATION

The present application is related to and claims priority to Korean Patent Application No. 10-2016-0169657 filed on Dec. 13, 2016, the disclosure of which is incorporated herein by reference.

TECHNICAL FIELD

Embodiments of the present disclosure relate to a refrigerator and a method of manufacturing an auger for the refrigerator, and more particularly, to a refrigerator with an improved ice transfer structure and a method of manufacturing an auger for the refrigerator.

BACKGROUND

Generally, a refrigerator is a home appliance which includes a storage compartment and a cold air supply which supplies cold air to the storage compartment and stores food in a fresh state. Such a refrigerator may include a dispenser configured to allow a user to get ice or water from an outside of the refrigerator without opening a door and an ice making chamber which makes ice to be provided to the user through the dispenser.

In such an ice making chamber, an ice maker which makes ice and an ice bucket which stores ice formed by the ice maker may be provided and an auger for transferring ice may be provided in the ice bucket.

A general auger includes a transfer portion spirally extended along a rotating shaft, and the transfer portion is cut at one part toward the rotating shaft to adjust an ice transfer amount to be adequate. However, when a piece of ice is caught between the above-cut one part of the transfer portion and an inner surface of the ice bucket, ice is broken and the broken ice is not transferred by the auger and remains in the ice bucket as a residual piece of ice.

SUMMARY

To address the above-discussed deficiencies, it is a primary object to provide a refrigerator capable of preventing ice from accumulating in an ice bucket by improving fluidity of ice in the ice bucket and a method of manufacturing an auger for the refrigerator.

It is another aspect of the present disclosure to provide a refrigerator capable of preventing ice from being broken between an ice bucket and an auger and a method of manufacturing an auger for the refrigerator.

It is still another aspect of the present disclosure to provide a refrigerator which minimizes residual ice present in an ice bucket by minimizing a section incapable of transferring ice and a method of manufacturing an auger for the refrigerator.

Additional aspects of the present disclosure will be set forth in part in the description which follows and, in part, will be obvious from the description, or may be learned by practice of the present disclosure.

In accordance with one aspect of the present disclosure, a refrigerator includes a body including a storage compartment, an ice maker provided in the storage compartment and configured to form ice, an ice bucket in which the ice formed by the ice maker is stored, and an auger provided in the ice bucket and including a rotating shaft and an extension portion radially extended from the rotating shaft while being spirally extended along the rotating shaft. Here, the extension portion includes a plurality of transfer portions including perimeter edges spirally extended and side edges radially extended and to be arranged to allow the perimeter edges to form a continuous spiral shape.

The extension portion may further include a plurality of passing portions formed between the plurality of transfer portions along a spiral direction formed by the perimeter edges The ice bucket may include an opening through which the ice is discharged to the outside of the ice bucket, and the extension portion may further include a discharge transfer portion provided on a side adjacent to the opening and configured to be reduced in a length radially extended from the rotating shaft when approaching the opening.

The refrigerator may further include a pulverizer connected to the opening and configured to pulverize the ice discharged through the opening.

A first end of the auger may be connected to the pulverizer, and a second end of the auger, opposite to the first end, may be connected to a driving part configured to rotate the auger.

The ice bucket may further include an escape prevention portion provided above the opening to prevent the ice transferred by the auger from escaping to the outside of the ice bucket.

The plurality of passing portions may be formed by radially cutting a part of the extension portion while spirally cutting along the rotating shaft.

The side edges of the plurality of transfer portions may include cut surfaces radially extended while being extended along the spiral direction in which the extension portion is extended.

At least some of the plurality of transfer portions may be provided to have a same size.

At least some of the plurality of transfer portions may be provided at a same interval along the rotating shaft.

At least some of the plurality of transfer portions may be provided to have a fan shape with a central angle of 120° when a surface vertical to the rotating shaft is viewed.

At least some of the plurality of passing portions may be provided to have a fan shape with a central angle of 120° when a surface vertical to the rotating shaft is viewed.

The plurality of transfer portions may be spirally arranged corresponding to a spiral shape in which the extension portion is extended.

The plurality of transfer portions may be provided to allow a distance between the perimeter edges and an inner surface of the ice bucket to be smaller than a size of the ice formed in the ice maker.

The plurality of transfer portions may each include a transfer surface configured to transfer the ice in a direction of the rotating shaft and a cut surface configured to transfer the ice upward.

In accordance with another aspect of the present disclosure, a refrigerator includes a body including a storage compartment, an ice maker provided in the storage compartment and configured to form ice, an ice bucket in which the ice formed by the ice maker is stored, and an auger provided in the ice bucket and including a rotating shaft and an extension portion radially extended from the rotating shaft while being spirally extended along the rotating shaft. Here, the extension portion includes a plurality of transfer portions spirally arranged along the rotating shaft and a plurality of passing portions formed by radially cutting parts between the plurality of transfer portions while spirally cutting along the rotating shaft.

The refrigerator may further include a pulverizer connected to a first side of the ice bucket. Here, the auger may include a discharge transfer portion provided on a side adjacent to the pulverizer and provided to reduce a length radially extended from the rotating shaft when approaching the pulverizer.

The plurality of transfer portions may each include a transfer surface configured to transfer the ice in a direction of the rotating shaft and a cut surface provided to transfer the ice upward and formed by cutting the extension portion to form the plurality of passing portions. Here, the cut surface may be provided to be extended in a spiral direction in which the plurality of transfer portions are extended.

In accordance with still another aspect of the present disclosure, a method of manufacturing an auger for a refrigerator includes providing a rotating shaft and an extension portion radially extended from the rotating shaft while being extended spirally and forming a plurality of passing portions by radially cutting a part of the extension portion while cutting in a spiral direction in which the extension portion is extended. Here, the forming of the plurality of passing portions may include forming cut surfaces radially extended while being extended along the spiral direction in which the extension portion is extended, at a plurality of transfer portions formed on a remaining side of the extension portion.

The method may further include, after the providing of the rotating shaft and the extension portion or the forming of the plurality of passing portions, forming a discharge transfer portion by cutting an end of the extension portion along the spiral direction in which the extension portion is extended while cutting to reduce a length radially extended from the rotating shaft when approaching the end of the extension portion.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
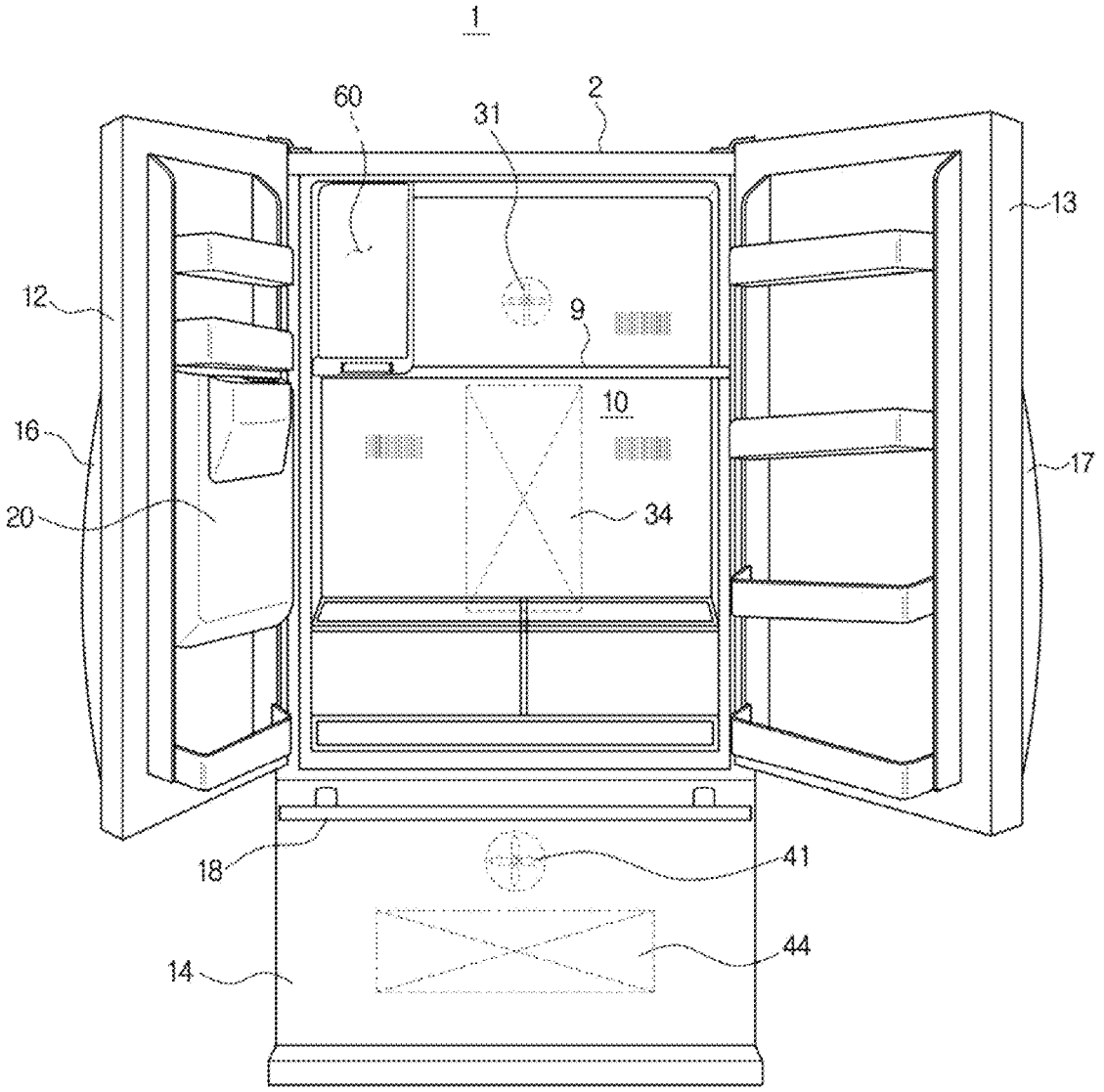
FIG. 1 is a view illustrating an exterior of a refrigerator according to one embodiment of the present disclosure.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments disclosed in the specification and components shown in the drawings are merely preferable examples of the present disclosure and various modifications capable of replacing the embodiments and drawings of the specification may be formed at the time of filing the present application.

Also, throughout the drawings of the present specification, like reference numerals or symbols refer to components or elements configured to perform substantially identical functions.

Also, the terms used herein are intended to explain the embodiments but are not intended to limit and/or define the present disclosure. Singular forms, unless defined otherwise in context, include plural forms. Throughout the specification, the terms "comprise", "have", and the like are used herein to specify the presence of stated features, numbers, steps, operations, elements, components or combinations thereof but do not preclude the presence or addition of one or more other features, numbers, steps, operations, elements, components, or combinations thereof.

Also, even though the terms including ordinals such as first, second and the like may be used for describing various components, the components will not be limited by the terms and the terms are used only for distinguishing one element from others. For example, without departing from the scope of the present disclosure, a first component may be referred to as a second component, and similarly, the second component may be referred to as the first component. The term "and/or" includes any and all combinations or one of a plurality of associated listed items.

Meanwhile, the terms "frontward", "rearward", "above", "below", "a top end", "a bottom end", and the like used below are defined on the basis of the drawings and shapes and positions of components are not limited thereto.

Hereinafter, the embodiments will be described in detail with reference to the attached drawings.

Figure 2:
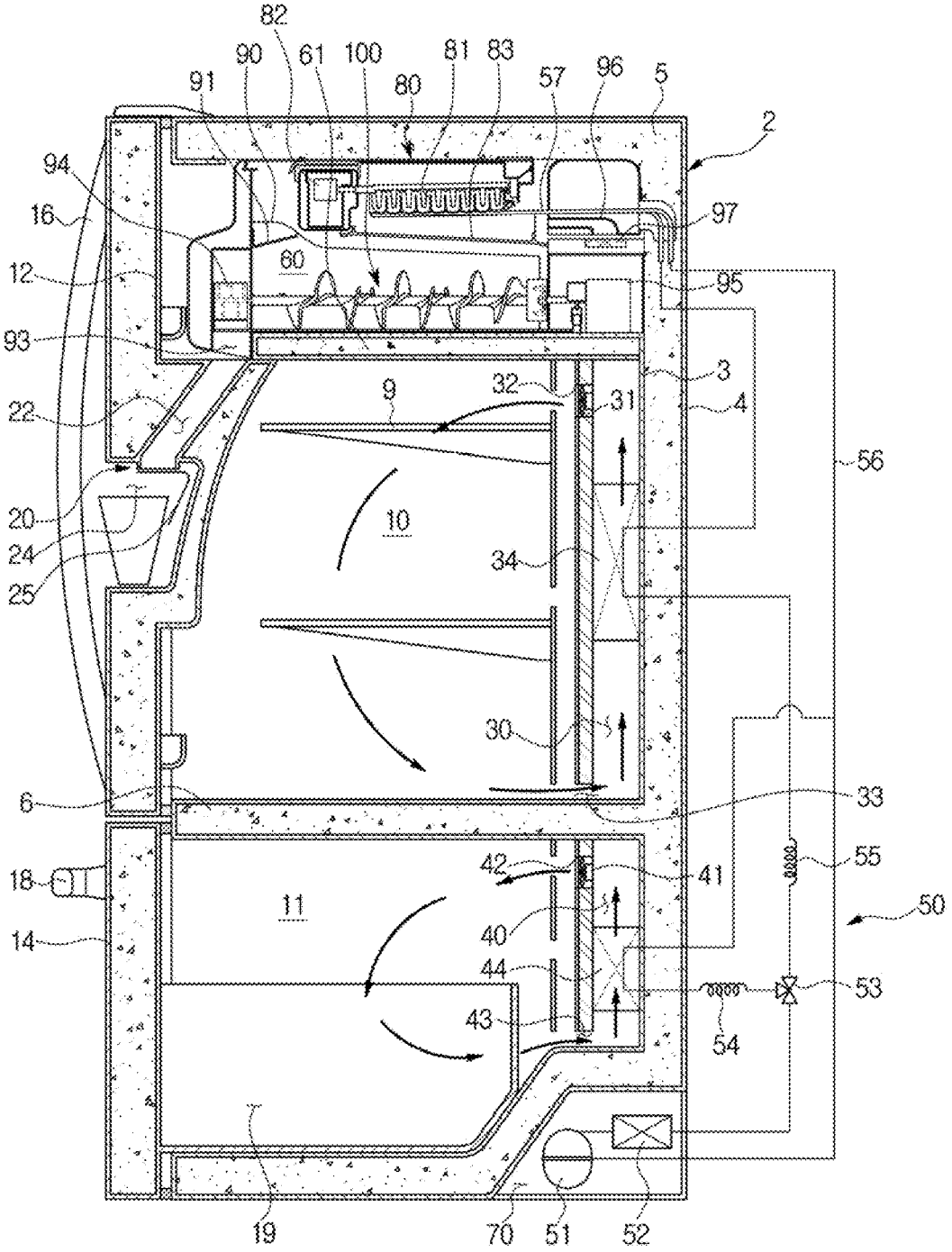
FIG. 2 is a schematic cross-sectional view illustrating an inner configuration of the refrigerator of FIG. 1.
Figure 3:
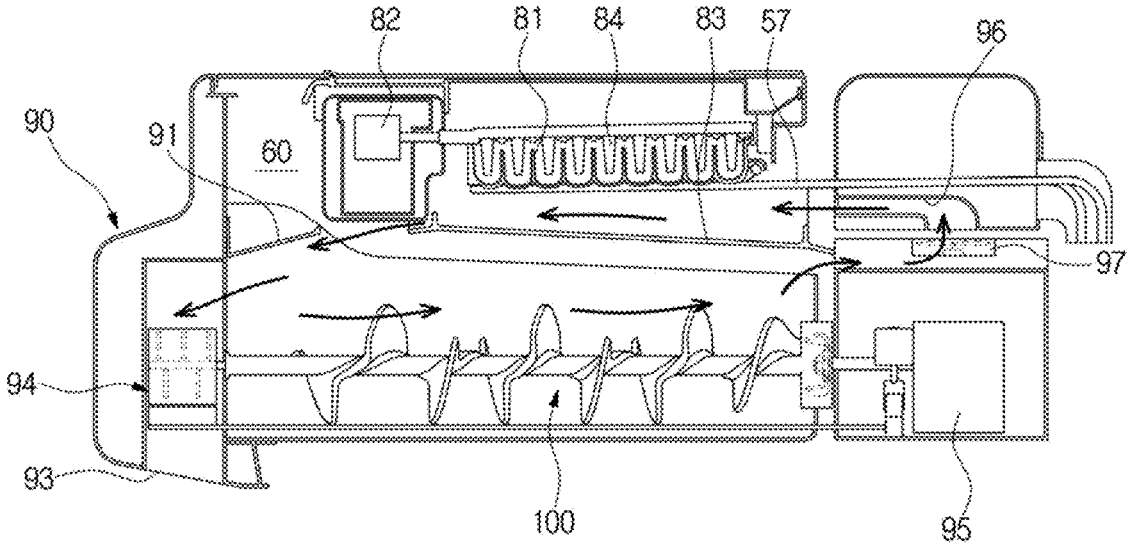
FIG. 3 is an enlarged schematic cross-sectional view illustrating a configuration of an ice making chamber of the refrigerator of FIG. 1.

FIG. 1 is a view illustrating an exterior of a refrigerator 1 according to one embodiment of the present disclosure. FIG. 2 is a schematic cross-sectional view illustrating an inner configuration of the refrigerator 1 of FIG. 1. FIG. 3 is an enlarged schematic cross-sectional view illustrating a configuration of an ice making chamber 60 of the refrigerator 1 of FIG. 1.

Referring to FIGS. 1 to 3, the refrigerator 1 according to one embodiment of the present disclosure may include a body 2, storage compartments 10 and 11 capable of storing food to be cold or frozen, an ice making chamber 60 formed to be partitioned from the storage compartments 10 and 11 by an ice making chamber wall 61, and a cooling apparatus 50 for supplying cold air to the ice making chamber 60.

The body 2 may include an inner casing 3 which forms the storage compartments 10 and 11, an outer casing 4 which is coupled to an outside of the inner casing 3 and forms an exterior, and an insulator 5 which is foam between the inner casing 3 and the outer casing 4.

The storage compartments 10 and 11 may be formed to have open front surfaces and may be partitioned into a refrigerator compartment 10 above and a freezer compartment 11 below by a horizontal partition wall 6. The horizontal partition wall 6 may include an insulator for preventing heat exchange between the refrigerator compartment 10 and the freezer compartment 11.

A rack 9 capable of accommodating food thereon and vertically partitioning a storage space of the refrigerator compartment 10 may be disposed in the refrigerator compartment 10. The open front surface of the refrigerator compartment 10 may be opened and closed by a pair of rotatable doors 12 and 13 hinge-coupled to the body 2.

The door 12 may include a dispenser 20 to allow ice I of the ice making chamber 60 to be taken outside without opening the door 12. The dispenser 20 may include a take-out space 24 for taking out the ice I, a lever 25 for selecting whether to take out the ice I, and a chute 22 which guides the ice I discharged through an opening 92 to the take-out space 24.

The open front surface of the freezer compartment 11 may be opened and closed by a sliding door 14 which is slidably insertable into the freezer compartment 11. A storage box 19 capable of accommodating food may be provided on a rear surface of the sliding door 14. A handle 18 for opening and closing the sliding door 14 may be provided on the sliding door 14.

The cooling apparatus 50 may include a compressor 51 which compresses a refrigerant with a high pressure, a condenser 52 which condenses the compressed refrigerant, expansion devices 54 and 55 which expand the refrigerant at a low pressure, evaporators 34 and 44 which generate cold air by evaporating the refrigerant, and a refrigerant pipe 56 which guides the refrigerant.

The compressor 51 and the condenser 52 may be disposed in a machine compartment 70 provided at a rear lower portion of the body 2. Also, the evaporators 34 and 44 may be arranged in a refrigerator compartment cold air supply duct 30 provided in the refrigerator compartment 10 and a freezer compartment cold air supply duct 40 provided in the freezer compartment 11, respectively.

The refrigerator compartment cold air supply duct 30 may include an inlet 33, a cold air outlet 32, and an air-blowing fan 31 and circulate cold air throughout the refrigerator compartment 10. Also, the freezer compartment cold air supply duct 40 may include an inlet 43, a cold air outlet 42, and an air-blowing fan 41 and circulate cold air throughout the freezer compartment 11.

The refrigerant pipe 56 may allow a refrigerant to flow through the freezer compartment 11 or may diverge at one point to allow the refrigerant to flow to the refrigerator compartment 10 and the ice making chamber 60. A switching valve 53 for switching a flow path of the refrigerant may be installed at a branch point thereof.

One part 57 of the refrigerant pipe 56 may be disposed in the ice making chamber 60 to cool the ice making chamber 60. The refrigerant pipe 57 disposed in the ice making chamber 60 may come into contact with an ice making tray 81 and may directly supply cooling energy to the ice making tray 81 by heat conduction. Hereinafter, the one part 57 of the refrigerant pipe 56 disposed in the ice making chamber 60 to come into contact with the ice making tray 81 will be referred to as an ice making chamber refrigerant pipe 57.

A refrigerant in a liquid state, which passes through an expansion device 55 and comes to a low-temperature and low-pressure state, may flow through an inside of the ice making chamber refrigerant pipe 57 and absorb heat inside the ice making tray 81 and the ice making chamber 60 and may be vaporized to a gaseous state. Accordingly, the ice making chamber refrigerant pipe 57 and the ice making tray 81 may function as an evaporator in the ice making chamber 60.

An ice maker 80 may include the ice making tray 81 which stores water for making ice, an ejector 84 which separates the ice I from the ice making tray 81, an ice detachment motor 82 which rotates the ejector 84, an ice detachment heater (not shown) which applies heat to the ice making tray 81 to easily separate the ice I from the ice making tray 81, an ice bucket 90 which stores the ice I formed in the ice making tray 81, a drain duct 83 which collects water generated by defrosting the ice making tray 81 and simultaneously guides a flow of air in the ice making chamber 60, and an ice making chamber fan 97 which circulates the air in the ice making chamber 60.

The ice bucket 90 may be disposed below the ice making tray 81 to collect the ice I which drops from the ice making tray 81. An auger 100 which transfers the stored ice I to the opening 92 may be provided in the ice bucket 90, and a driving part 95 which drives the auger 100 may be provided on one side of the ice bucket 90. The driving part 95 may be a motor.

Here, the auger 100 will be described below in detail.

Also, the ice bucket 90 may include the opening 92 formed to discharge the ice I to the outside of the ice bucket 90, on the other side opposite to the one side on which the driving part 95 is provided. The opening 92 may be connected to a pulverizer 94 capable of pulverizing the ice I.

An escape prevention portion 91 which covers a part of an open top of the ice bucket 90 may be provided on one side of the ice bucket 90, at which the opening 92 is provided, to prevent the ice I which is not discharged through the opening 92 from accumulating and escaping from the ice bucket 90. The escape prevention portion 91 may have a rib shape extended with a certain length from an inner surface of the ice bucket 90.

The driving part 95 may be disposed behind the ice making chamber 60, and the ice making chamber fan 97 may be disposed above the driving part 95. A guide flow path 96 which guides air discharged from the ice making chamber fan 97 toward the ice making chamber 60 may be provided above the ice making chamber fan 97.

The air forcibly moved by the ice making chamber fan 97 may be circulated through the ice making chamber 60 in a direction of an arrow shown in FIG. 3. That is, the air discharged above the ice making chamber fan 97 may pass through the guide flow path 96 and flow between the ice making tray 81 and the drain duct 83. Here, the air is heat-exchanged with the ice making tray 81 and the ice making chamber refrigerant pipe 57 and the cooled air may flow toward the opening 92 of the ice bucket 90 and may be suctioned into the ice making chamber fan 97 again.

Figure 4:
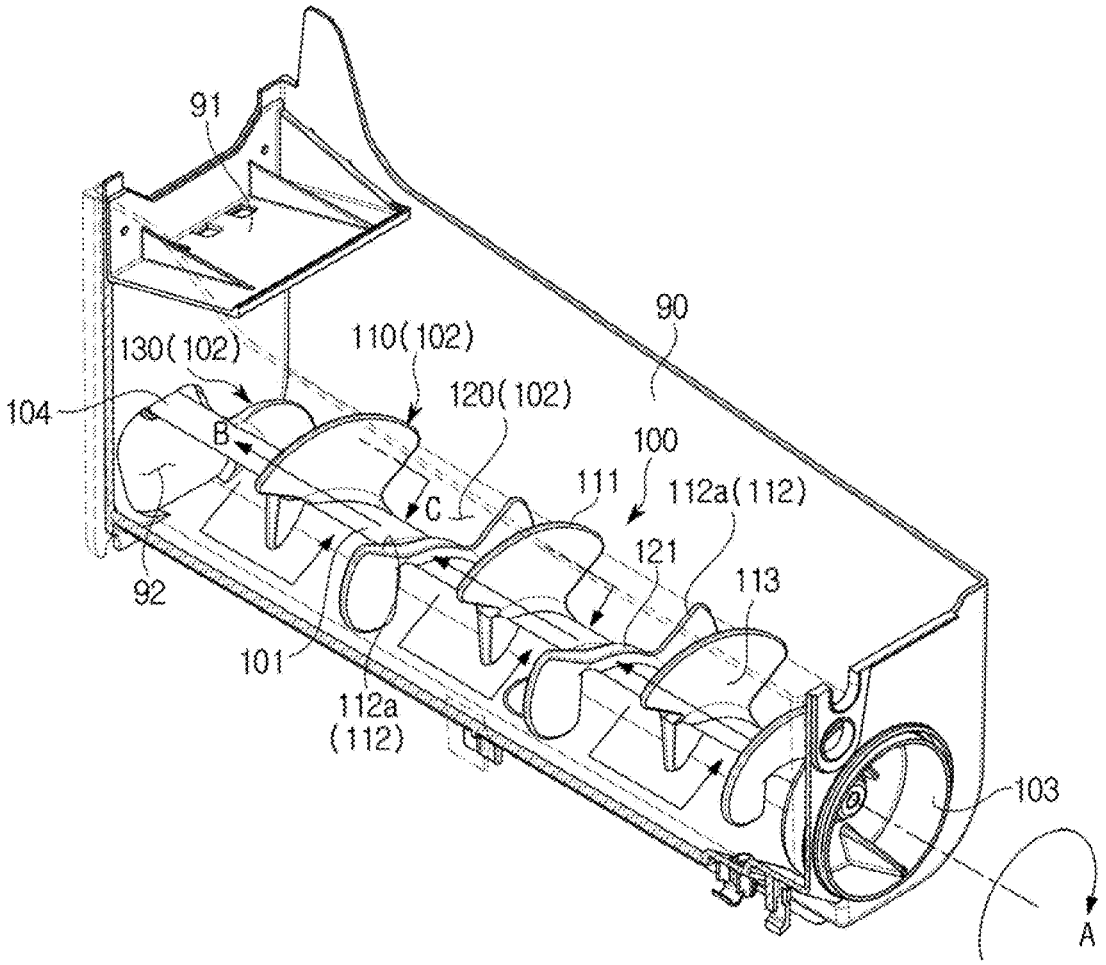
FIG. 4 is a view illustrating an inside of an ice bucket shown in FIG. 2.
Figure 5:
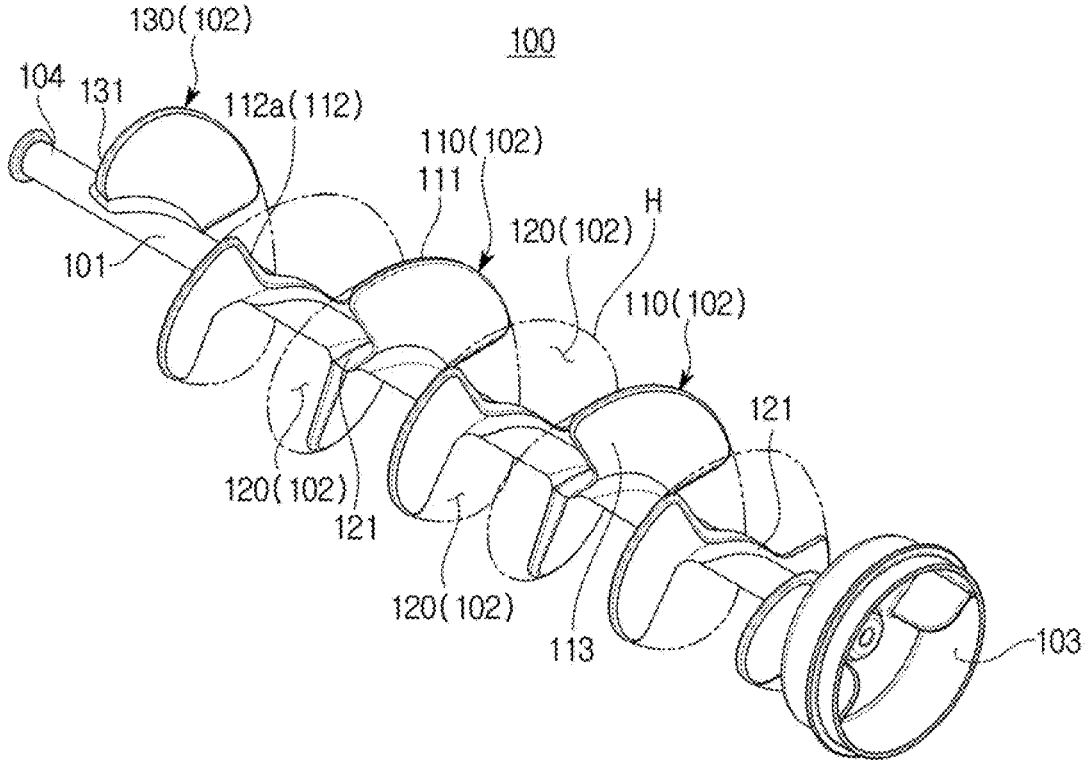
FIG. 5 is a view illustrating an auger shown in FIG. 4.
Figure 6:
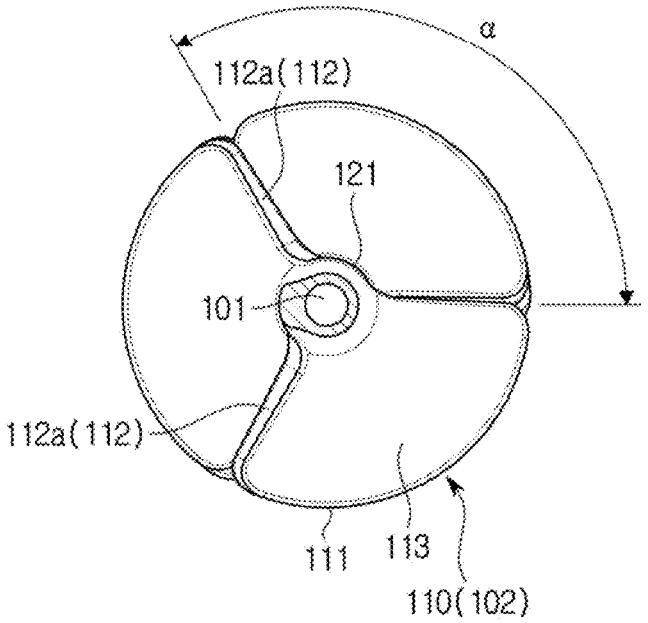
FIG. 6 is a cross-sectional view illustrating the auger shown in FIG. 5 taken along a surface vertical to a rotating shaft.
Figure 7:
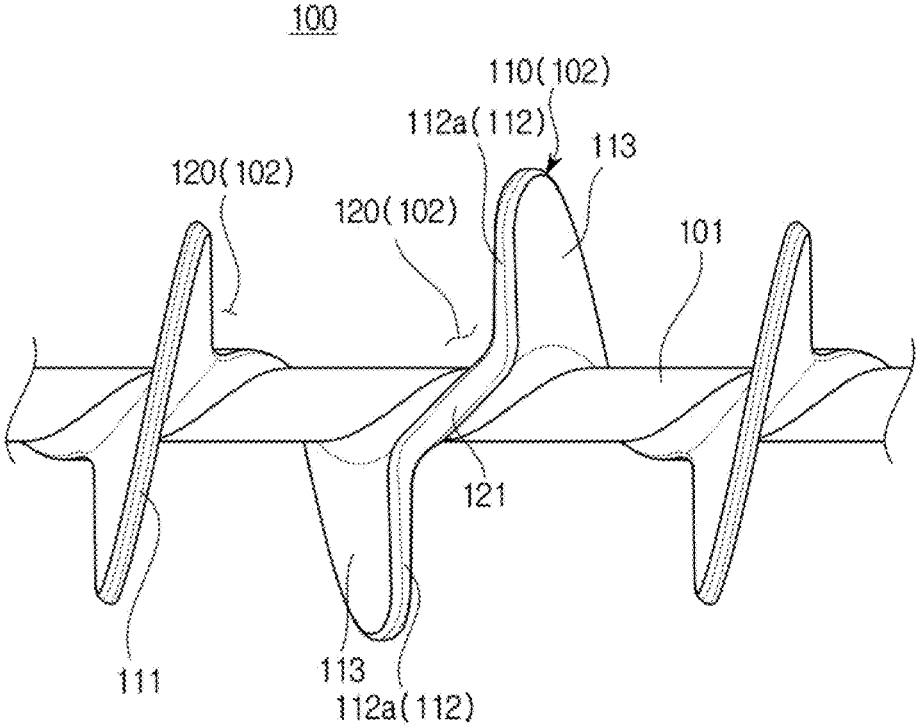
FIG. 7 is an enlarged side view illustrating a part of the auger shown in FIG. 4.
Figure 8:
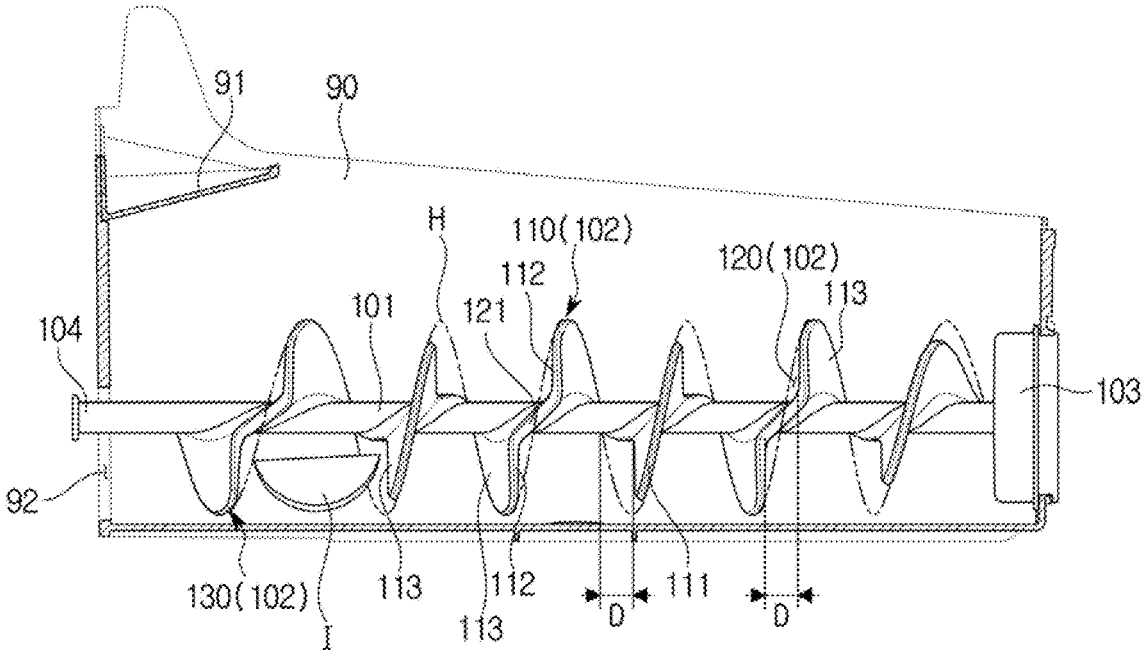
FIG. 8 is a side perspective view illustrating the inside of the ice bucket shown in FIG. 4.

FIG. 4 is a view illustrating an inside of an ice bucket 90 shown in FIG. 2. FIG. 5 is a view illustrating the auger 100 shown in FIG. 4. FIG. 6 is a cross-sectional view illustrating the auger 100 shown in FIG. 5 taken along a surface vertical to a rotating shaft 101. FIG. 7 is an enlarged view illustrating a part of a side of the auger 100 shown in FIG. 4. FIG. 8 is a side view illustrating an inside of the ice bucket 90 shown in FIG. 4.

Referring to FIGS. 4 to 7, the auger 100 of the ice bucket 90 according to one embodiment of the present disclosure will be described. The auger 100 according to one embodiment of the present disclosure may be disposed in an inner space in the ice bucket 90 and provided to be rotatable with respect to the ice bucket 90. The auger 100 may include the rotating shaft 101, an extension portion or thread 102 extended from the rotating shaft 101, a driving connector 103 connected to the driving part 95, and a pulverizer connector 104 connected to the pulverizer 94.

The rotating shaft 101 may be extended along a longitudinal direction of the ice bucket 90. The driving connector 103 connected to the driving part 95 may be provided on one end of the rotating shaft 101, the pulverizer connector 104 connected to the pulverizer 94 may be provided on the other end opposite to the one end. The rotating shaft 101 may be extended in a front-rear direction.

The extension portion 102 may be radially extended from the rotating shaft 101 and extended in a spiral shape H along the rotating shaft 101. The extension portion 102 may include a plurality of transfer portions or a plurality of extensions 110 provided to transfer the ice I and a plurality of passing portions or a plurality of passing grooves 120 provided to pass the ice I to reduce a transfer speed of the ice I.

The plurality of transfer portions 110 may each include a perimeter edge 111 formed along a spiral direction in which the extension portion 102 is extended and a side edge 112 radially extended. In the embodiment, the side edge 112 is formed by cutting a part of the extension portion 102 but is not limited thereto. The side edge 112 may be formed by a die caster when the auger 100 is manufactured through a mold-injection method.

Referring to FIG. 5, the plurality of transfer portions 110 may be arranged to allow the perimeter edges 111 to form a continuous spiral shape. In other words, the spiral shape H connecting the perimeter edges 111 may be provided so as to be identical to the spiral shape in which the extension portion 102 is extended. That is, the plurality of transfer portions 110 may be arranged in the spiral shape H corresponding to the spiral shape in which the extension portion 102 is extended.

At least some of the plurality of transfer portions 110 may be provided to have the same size. In addition, at least some of the plurality of transfer portions 110 may be provided at the same interval along the rotating shaft 101. The size and the interval of the plurality of transfer portions 110 may be set in consideration of a size of the ice I formed in the ice making tray 81.

Referring to FIG. 6, the plurality of transfer portions 110 may be provided to have a fan shape having a central angle $\alpha$ of approximately 120° when the surface vertical to the rotating shaft 101 is viewed. In addition, the plurality of passing portions 120 which will be described below may be provided to have a fan shape having a central angle $\alpha$ of approximately 120° when the surface vertical to the rotating shaft 101 is viewed. Accordingly, the plurality of transfer portions 110 of the auger 100 according to one embodiment of the present disclosure may be spirally extended along the rotating shaft 101 and three transfer portions 110 may be set to be one cycle and repeatedly formed. However, the sizes and the shapes of the plurality of transfer portions 110 and the plurality of passing portions 120 may be changed as necessary and may be set in consideration of an amount of the ice I storable in the ice bucket 90 and a discharge speed which allows the ice I to be discharged and not accumulated.

The plurality of transfer portions 110 may be provided to allow a gap between the perimeter edge 111 and the inner surface of the ice bucket 90 to be smaller than the size of the ice I formed in the ice making tray 81. Accordingly, the refrigerator 1 according to one embodiment of the present disclosure may prevent the ice I formed in the ice making tray 81 from being caught and broken between the perimeter edges 111 of the plurality of transfer portions 110 and the inner surface of the ice bucket 90.

The side edge 112 of the plurality of transfer portions 110 may be radially extended from both ends of the perimeter edge 111 and extended along the spiral direction in which the extension portion 102 is extended. When the side edge 112 is formed by cutting, the side edge 112 may include a cut surface **112*a* formed by the cutting. The cut surface 112*a* may continue along the spiral direction in which a passing portion forming surface 121 which will be described below and the extension portion 102 are extended and may be formed in an approximately vertical direction. That is, the extension portion 102 according to one embodiment of the present disclosure may be provided to allow the perimeter edges 111, the side edges 112, and the passing portion forming surfaces or a plurality of passing groove surfaces 121 of the plurality of transfer portions 110 to continue along the spiral direction in which the extension portion 102** is extended.

The side edges 112 of the plurality of transfer portions 110 may move the ice I upward according to a gravitational direction. That is, the plurality of transfer portions 110 may move the ice I below the ice bucket 90 upward in a discharge direction B or a direction opposite to the discharge direction B.

The plurality of transfer portions 110 may include transfer surfaces 113 which transfer the ice I in a direction of the rotating shaft 101. The transfer surfaces 113 may move the ice I forward or backward. The plurality of transfer portions 110 are spirally extended such that the transfer surfaces 113 may be provided as spiral surfaces. The transfer surfaces 113 may transfer some of the ice I in the discharge direction B and may transfer the remaining part of the ice I in the direction opposite to the discharge direction B.

The plurality of passing portions 120 may be formed between the plurality of transfer portions 110 along the spiral direction formed by the perimeter edges 111 of the plurality of transfer portions 110. According to one embodiment of the present disclosure, the plurality of passing portions 120 may be formed by cutting one part of the extension portion 102.

In detail, the rotating shaft 101 and the extension portion 102 radially extended from the rotating shaft 101 while being continuously and spirally extended may be provided, and then the plurality of passing portions 120 may be formed by radially cutting one part of the extension portion 102 while cutting in the spiral direction in which the extension portion 102 is extended. Accordingly, the plurality of transfer portions 110 may include the cut surfaces 112*a* which are radially extended while being extended in the spiral direction in which the extension portion 102 is extended.

Accordingly, the plurality of passing portions 120 may include the passing portion forming surfaces 121 provided to be adjacent to the rotating shaft 101. The passing portion forming surfaces 121 may be viewed as another part of the extension portion 102, which remains after cutting for forming the plurality of passing portions 120.

In addition, after the rotating shaft 101 and the extension portion 102 are provided or the plurality of passing portions 120 are formed, a discharge transfer portion or a discharge thread 130 which will be described below may be formed. Here, the discharge transfer portion 130 may be formed by cutting front ends of a plurality of such extension portions 102 in the spiral direction in which the extension portion 102 is extended to reduce a length radially extended from the rotating shaft 101 while approaching a front of the extension portion 102.

However, the plurality of passing portions 120 are not limited to formation by cutting and may be formed by a die caster when the auger 100 is manufactured through a mold-injection method.

The plurality of passing portions 120 may reduce a discharge speed of the ice I. That is, an amount of the ice I transferred in the discharge direction B by the plurality of passing portions 120 may be reduced, and accordingly, it is possible to prevent the ice I from accumulating on one side of the ice bucket 90, at which the opening 92 is provided.

In addition, the plurality of passing portions 120 may allow the ice I to move in the discharge direction B and an opposite direction C thereof. That is, since the auger 100 according to one embodiment of the present disclosure maintains an adequate amount of the ice I discharged by the plurality of passing portions 120, it is possible to prevent the ice I from accumulating in the ice bucket 90 and accordingly to prevent the accumulated ice I from being broken by mutual impact. In addition, since the plurality of passing portions 120 may transfer the ice I in the discharge direction B and the opposite direction C, the ice I stored in the ice bucket 90 may be circulated.

The plurality of passing portions 120, as described above, may be provided to have a fan shape having a central angle $\alpha$ of approximately 120° when the surface vertical to the rotating shaft 101 is viewed.

The above-described plurality of transfer portions 110 and the plurality of passing portions 120 may be alternately provided along the rotating shaft 101 in the spiral direction. In detail, as described above, the plurality of transfer portions 110 may be arranged at intervals of approximately 120° when the surface vertical to the rotating shaft 101 is viewed, and the plurality of passing portions 120 may be arranged at intervals of approximately 120° when the surface vertical to the rotating shaft 101 is viewed. According to the above-described configuration, the refrigerator 1 according to one embodiment of the present disclosure may increase an amount of the ice I storable in the inner space of the ice bucket 90.

Referring to FIG. 8, since the plurality of transfer portions 110 are spirally extended and the plurality of passing portions 120 are formed in the spiral direction in which transfer portions 110 are extended, when viewed from a side, a gap D in which the ice I is not transferred may be minimized. Accordingly, the auger 100 configured as described above may minimize an amount of the ice incapable of being transferred by the auger 100.

The extension portion 102 may include the discharge transfer portion 130 provided on one side adjacent to the opening 92 and decreased in a length radially extended from the rotating shaft 101 when approaching the opening 92. The discharge transfer portion 130 may be provided to be adjacent to the pulverizer connector 104 of the rotating shaft 101 connected to the pulverizer 94. The discharge transfer portion 130 may include a radius reduction portion 131 at which the length radially extended from the rotating shaft 101 is reduced. Due to the above-described discharge transfer portion 130, the auger 100 according to one embodiment of the present disclosure may prevent the ice I from being caught or accumulating in a space between the inner surface of the ice bucket 90, at which the opening 92 is formed, and the discharge transfer portion 130 and may move the ice I in the discharge direction B and the opposite direction C.

Figure 9:
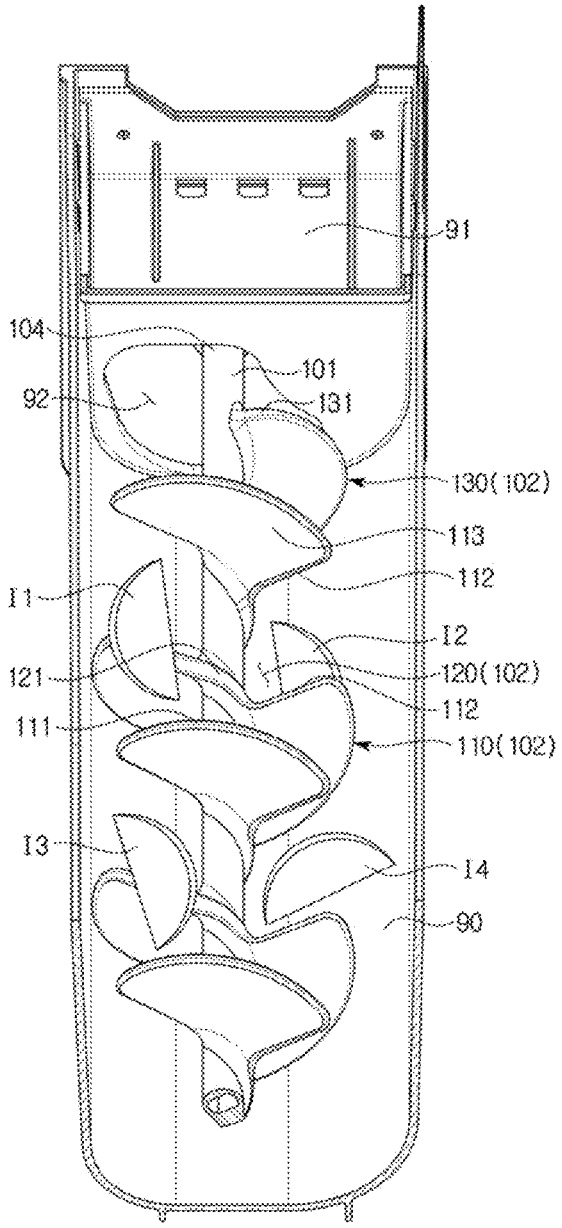
FIGS. 9 and 10 are views illustrating a state in which ice is transferred in the ice bucket shown in FIG. 4.
Figure 10:
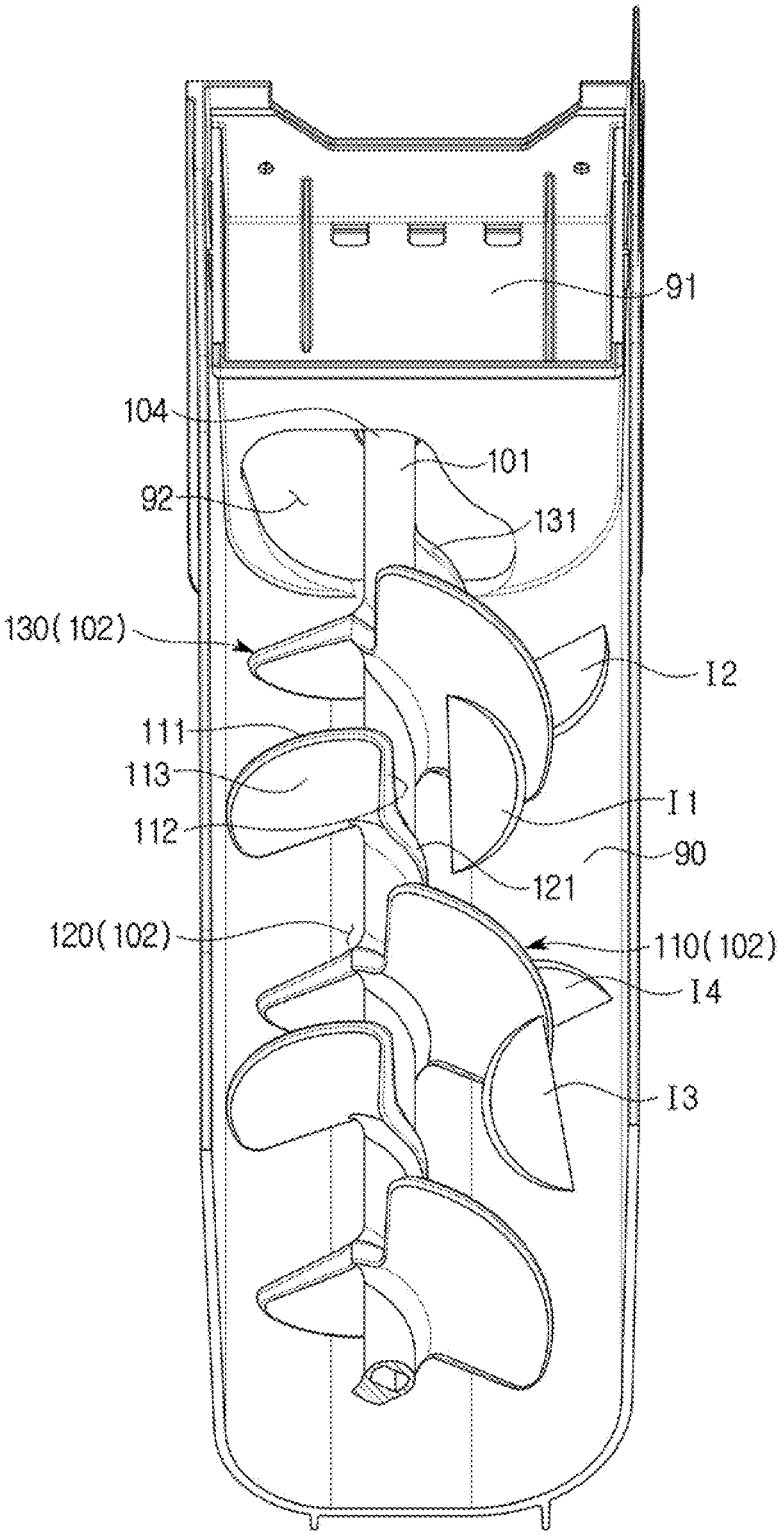
Figure 11:
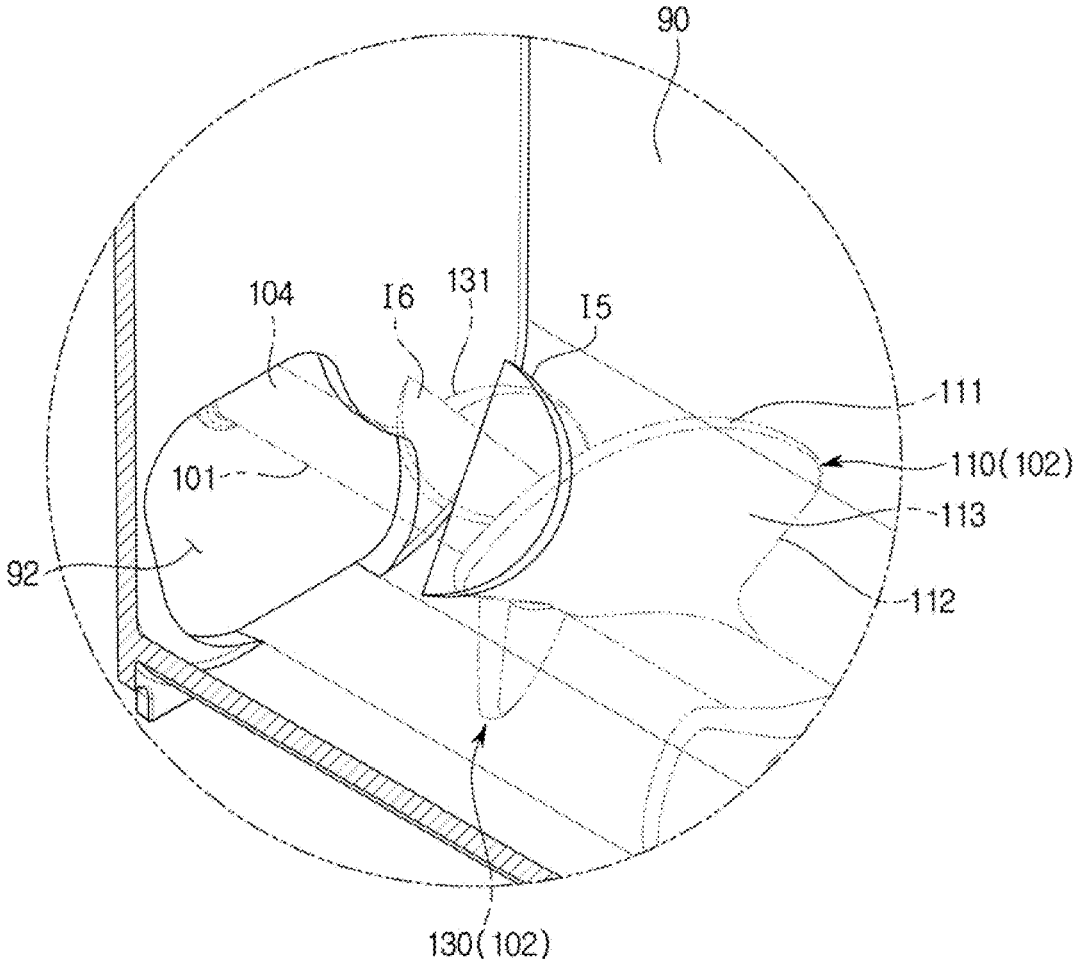
FIG. 11 is a view illustrating a movement of ice on one side of the ice bucket shown in FIG. 4, at which an opening is provided.

FIGS. 9 and 10 are views illustrating a state in which the ice I is transferred in the ice bucket shown in FIG. 4. FIG. 11 is a view illustrating a movement of the ice I on one side of the ice bucket 90 shown in FIG. 4, at which the opening 92 is provided.

Referring to FIGS. 9 to 11, a process in which the auger 100 according to one embodiment of the present disclosure transfers the ice I will be described.

First, referring to FIGS. 9 and 10, some ice pieces I1 and I3 may be transferred to a top of the ice bucket 90 by the side edges 112 of the plurality of transfer portions 110. The ice pieces I1 and I3 moved upward by the side edges 112 may move through a space between the plurality of transfer portions 110 along the direction of the rotating shaft 101. Here, the ice pieces I1 and I3 moved upward by the side edges 112 may be transferred forward or backward by a certain distance.

Other ice pieces I2 and I4 may be transferred forward or backward by the transfer surfaces 113 of the plurality of transfer portions 110.

Subsequently, referring to FIG. 11, the discharge transfer portion 130 provided on one side of the rotating shaft 101 adjacent to the opening 92 may transfer ice pieces I5 and I6 to allow the underlying ice piece I5 to lift the ice piece I6 on top when the ice pieces I5 and I6 accumulate on the one side of the ice bucket 90, at which the opening is formed. Here, since the discharge transfer portion 130 includes the radius reduction portion 131, the ice piece I6 on top may be transferred by the radius reduction portion 131 in the discharge direction B and the opposite direction C. According to the above-described configuration, the auger 100 according to one embodiment of the present disclosure may conveniently discharge ice in the ice bucket 90 through the opening 92.

As is apparent from the above description, in a refrigerator according to one embodiment of the present disclosure, since an auger is capable of smoothly transferring ice in a transfer direction and a reverse transfer direction, it is possible to prevent ice from accumulating in an ice bucket.

In the refrigerator according to one embodiment of the present disclosure, since a space formed between the ice bucket and the auger is provide to have a smaller size than that of ice formed by an ice maker, it is possible to prevent ice from being caught in the space formed between the ice bucket and the auger.

In the refrigerator according to one embodiment of the present disclosure, since a transfer portion is spirally disposed to form a continuous peripheral edge of the transfer portion, a section incapable of transferring ice is minimized to minimize the amount of residual ice present in the ice bucket.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a body comprising a storage compartment;

an ice maker provided in the storage compartment and configured to form ice;

an ice bucket in which the ice formed by the ice maker is stored; and an auger provided in the ice bucket and comprising:

a rotating shaft, and a thread radially extended from the rotating shaft and extended along the rotating shaft in a spiral direction, wherein the thread comprises:

perimeter edges spirally extended, side edges radially extended and arranged to allow the perimeter edges to form a spiral shape, and a plurality of passing groove surfaces formed adjacent to the rotating shaft in the spiral direction, wherein each of the plurality of passing groove surfaces are separated from one of the perimeter edges by one of the side edges, wherein the ice bucket comprises an opening through which the ice is discharged to the outside of the ice bucket, and wherein the thread further comprises a discharge thread provided on a side adjacent to the opening and configured to be reduced in a length radially extended from the rotating shaft when approaching the opening.

2. The refrigerator of claim 1, wherein the thread further comprises a plurality of passing grooves that include the plurality of passing groove surfaces and are formed by the perimeter edges.

3. The refrigerator of claim 2, wherein the plurality of passing grooves are formed by radially cutting a part of the thread while spirally cutting along the rotating shaft.

4. The refrigerator of claim 3, wherein:

the side edges comprise cut surfaces radially extended while being extended along a spiral in which the thread is extended.

5. The refrigerator of claim 2, wherein at least some of the plurality of passing grooves are provided to have a fan shape with a central angle of 120° when a surface vertical to the rotating shaft is viewed.

6. The refrigerator of claim 1, further comprising a pulverizer connected to the opening and configured to pulverize the ice discharged through the opening.

7. The refrigerator of claim 6, wherein a first end of the auger is connected to the pulverizer, and a second end of the auger, opposite to the first end, is connected to a driving motor configured to rotate the auger.

8. The refrigerator of claim 1, wherein the ice bucket further comprises an escape prevention rib provided above the opening to prevent the ice transferred by the auger from escaping to the outside of the ice bucket.

9. The refrigerator of claim 1, wherein portions of the thread between each of a plurality of passing grooves are provided to have a same size.

10. The refrigerator of claim 1, wherein portions of the thread are provided at a same interval as a plurality of passing grooves are provided along the rotating shaft.

11. The refrigerator of claim 1, wherein the thread comprises a plurality of extensions, each extension provided in a fan shape with a central angle of 120° when a surface vertical to the rotating shaft is viewed.

12. The refrigerator of claim 1, wherein the perimeter edges and plurality of passing groove surfaces form the spiral shape in which the thread is extended.

13. The refrigerator of claim 1, wherein the thread is provided with a distance between the perimeter edges and an inner surface of the ice bucket that is smaller than a size of the ice formed in the ice maker.

14. The refrigerator of claim 1, wherein the thread further comprises:

a transfer surface configured to transfer the ice in a direction of the rotating shaft, and a cut surface configured to transfer the ice upward.

15. A refrigerator comprising:

a body comprising a storage compartment;

an ice maker provided in the storage compartment and configured to form ice;

an ice bucket in which the ice formed by the ice maker is stored;

a pulverizer connected to a first side of the ice bucket; and an auger provided in the ice bucket and comprising:

a rotating shaft, and a thread radially extended from the rotating shaft and extended along the rotating shaft in a spiral direction, wherein the thread comprises:

perimeter edges spirally extended, side edges radially extended and arranged to allow the perimeter edges to form a spiral shape; and a plurality of passing groove surfaces formed adjacent to the rotating shaft in the spiral direction by radially cutting parts between the side edges while spirally cutting along the rotating shaft, wherein each of the plurality of passing groove surfaces are separated from one of the perimeter edges by one of the side edges, wherein the auger comprises a discharge thread provided on a side adjacent to the pulverizer and provided to reduce a length radially extended from the rotating shaft when approaching the pulverizer.

16. The refrigerator of claim 15, wherein:

the thread further comprises a transfer surface configured to transfer the ice in a direction of the rotating shaft; and each of the side edges comprises a cut surface provided to transfer the ice upward and formed by cutting the thread to form the plurality of passing groove surfaces, and the cut surface is provided to be extended in the spiral direction in which the thread is extended.

* * * * *